US008882489B1

(12) United States Patent
Coomer

(10) Patent No.: US 8,882,489 B1
(45) Date of Patent: Nov. 11, 2014

(54) ICE SHAPING DEVICE

(75) Inventor: Kent Coomer, Lebanon, OH (US)

(73) Assignee: Coomer Properties, LLC, Lebanon, OH (US)

( * ) Notice: Subject to any disclaimer, the term of this patent is extended or adjusted under 35 U.S.C. 154(b) by 420 days.

(21) Appl. No.: 13/178,648

(22) Filed: Jul. 8, 2011

Related U.S. Application Data

(60) Provisional application No. 61/362,730, filed on Jul. 9, 2010.

(51) Int. Cl.
*B29C 43/02* (2006.01)
*B29C 43/50* (2006.01)

(52) U.S. Cl.
USPC ..... 425/407; 425/408; 425/422

(58) Field of Classification Search
CPC ..... B29C 43/02; B29C 43/04; B29C 43/50; B29C 2043/043; B29C 2043/5007; B29C 2043/503
USPC ..... 425/126.2, 129.1, 410, 398, 262, 263, 425/422, 412, 407–408
See application file for complete search history.

(56) References Cited

U.S. PATENT DOCUMENTS

| | | | | |
|---|---|---|---|---|
| 3,362,045 | A | 1/1968 | Jones-Hinton et al. | |
| 3,365,764 | A * | 1/1968 | Wall | 425/392 |
| 3,721,103 | A | 3/1973 | Brandt et al. | |
| 4,746,523 | A | 5/1988 | Binley | |
| 4,767,307 | A * | 8/1988 | Beer | 425/394 |
| 4,781,568 | A | 11/1988 | Inaba | |
| 4,971,737 | A | 11/1990 | Infanti | |
| 5,325,908 | A | 7/1994 | Sugishima | |
| 5,372,492 | A | 12/1994 | Yamauchi | |
| 5,425,248 | A | 6/1995 | Trantina | |
| 5,738,895 | A * | 4/1998 | Fuchs et al. | 426/515 |
| 5,786,004 | A * | 7/1998 | Yamauchi | 425/408 |
| 5,843,512 | A * | 12/1998 | Daouse et al. | 426/512 |
| 6,156,366 | A | 12/2000 | Waldstrøm et al. | |
| 6,561,787 | B2 * | 5/2003 | Karr et al. | 425/412 |
| 7,252,280 | B2 | 8/2007 | Hollands et al. | |
| 2004/0206250 | A1 | 10/2004 | Kondou et al. | |
| 2010/0055223 | A1 | 3/2010 | Kondou et al. | |

FOREIGN PATENT DOCUMENTS

| | | |
|---|---|---|
| JP | 56-21187 | 2/1981 |
| JP | 63-194271 A | 8/1988 |

(Continued)

*Primary Examiner* — Joseph S Del Sole
*Assistant Examiner* — Thukhanh Nguyen
(74) *Attorney, Agent, or Firm* — Wood, Herron & Evans, LLP

(57) ABSTRACT

An ice shaping device with upper and lower mold parts with a mold cavity, the upper mold part being configured to move toward the lower mold part by gravity. The mold parts are formed of a material capable of rapidly conducting heat and together having a mass such that, starting at room temperature, the mold parts possess sufficient transferable heat to melt away portions of an ice chunk blank in contact with the upper and lower mold parts, the upper mold part having sufficient mass to apply a significant amount of pressure, under the force of gravity, to portions of the ice chunk blank in contact with the mold parts. One of the mold parts has a predetermined exterior periphery and the other of the mold parts has an extension configured to substantially surround and slidably receive the external periphery of the first mold part.

7 Claims, 6 Drawing Sheets

(56) References Cited

FOREIGN PATENT DOCUMENTS

| | | | |
|---|---|---|---|
| JP | 1-310277 | A | 12/1989 |
| JP | 51-55056 | A | 6/1993 |
| JP | 5-83676 | | 11/1993 |
| JP | 6-194018 | A | 7/1994 |
| JP | 8-189737 | A | 7/1996 |
| JP | 9-203573 | A | 8/1997 |
| JP | 63-66773 | | 5/1998 |

* cited by examiner

ICE SHAPING DEVICE

RELATED APPLICATION

This application claims the benefit of U.S. Provisional Patent Application No. 61/362,730 filed Jul. 9, 2010.

TECHNICAL FIELD

This application relates to a device for quickly and easily transforming an irregularly-shaped piece of ice into a uniform shape, such as a sphere.

BACKGROUND

Whether for functionality or aesthetics, some prefer to chill a beverage served "on the rocks" using a relatively large, substantially spherical piece of ice. Devices for forming these ice pieces are described in US Patent Application Publication 2004/0206250, published Oct. 21, 2004, now abandoned, and US Patent Application Publication 2010/0055223, published Mar. 4, 2010. The entire disclosure of these published applications is incorporated herein by reference.

The devices disclosed in these published applications utilize a pair of mold halves formed from a material having relatively high heat conductivity. Those devices use guide rods that are inserted into guide openings to direct the mold halves toward one another in use. This design is rather expensive to manufacture, at least in part because guide bushings are usually required for smooth operation. Additionally, aligning multiple guide rods with guide openings can be cumbersome and the presence of these multiple guide rods around the cavity of at least one mold half can interfere with or limit placement of an ice chunk to be transformed.

SUMMARY OF THE INVENTION

The present invention provides a device for forming ice from an irregular chunk into a uniform shape, such as a sphere, that is simpler to manufacture and use than previously-existing devices. The guide rods, and their associated manufacturing costs and other drawbacks, can be eliminated in favor of the presently-disclosed design which provides a telescoping engagement of mold halves.

BRIEF DESCRIPTION OF THE DRAWINGS

Like reference numerals are used to indicate like parts throughout the various figures of the drawings, wherein.

DETAILED DESCRIPTION

Figure 2:
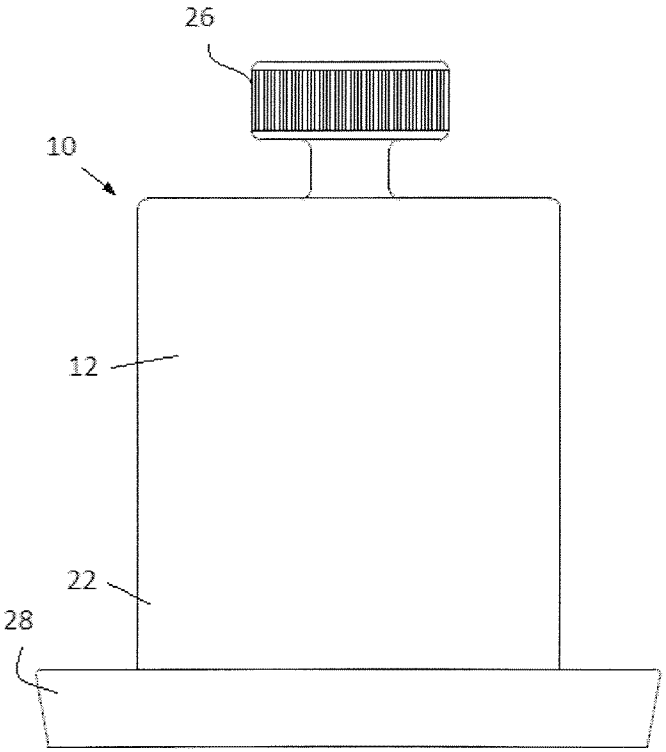
FIG. 2 is a side plan view of the device shown in FIG. 1.
Figure 1:
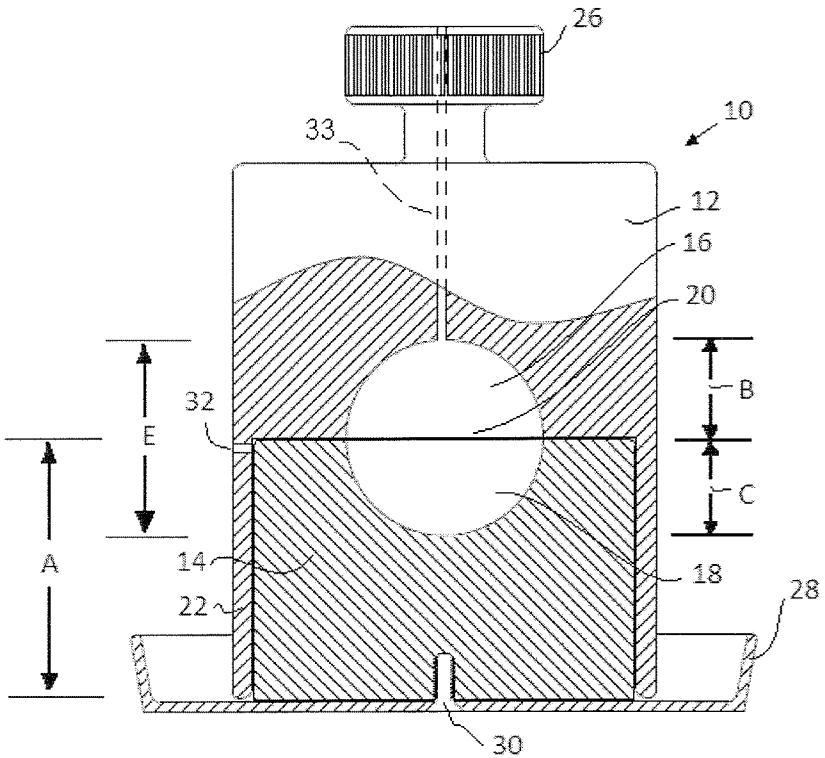
FIG. 1 is a partially cut-away plan view of an ice shaping device according to a preferred embodiment of the present invention.

Referring first to FIGS. 1-4, therein is shown at 10 an ice shaping device according to a first preferred embodiment of the invention. The device 10 comprises upper and lower mold parts 12, 14, each of which includes respective portions 16, 18 of a mold cavity 20. According to a preferred embodiment, one of the mold parts, in this example, the upper part 12 includes an extended housing 22, which is sized and shaped to substantially surround and slidably receive an external periphery of the lower mold part 14. In the illustrated embodiment, the outer periphery of the lower mold part 14 and the inner periphery of the extended housing 22 are both substantially cylindrical. This shape is easy to manufacture, but other shapes that provide an engageable fit to direct the mold parts 12, 14 in a slidable arrangement relative to one another may also be suitable or acceptable.

The exact shape of the upper and lower portions 16, 18 of the mold cavity 20, as well as those of the upper and lower mold parts 12, 14, may vary considerably. It is desirable, however, that the length A of the extended housing 22 be at least the combined depths B, C of the upper and lower portions 16, 18 of the mold cavity 20. Additionally, at least with respect to the illustrated embodiment, it is desirable that the length A of the extended housing 22 be no more than the height D of the exposed outer surface of the lower mold part 14.

The upper 12 and lower 14 parts of the device 10 are formed from a material having a relatively high heat conductivity. A person of ordinary skill in the art would know to select a suitable material, such as aluminum or similar metal alloy, that balances the desired characteristics of thermal conductivity, machinability, and cost. Additionally, the mold parts 12, 14 should include a significant mass of material for at least two reasons. First, the mass of heat-conductive material needs to be capable of possessing, preferrably at room temperature, an adequate amount of transferrable heat energy sufficient to melt and transform portions of a raw ice block, reducing it to the remaining volume of the mold cavity 20. Second, at least the upper part 12 should have sufficient mass such that, under the force of gravity and without other applied force, a significant amount of pressure is applied to the ice block 24 to aid in the melting and reshaping process. As used herein, a "significant" amount of pressure is defined as enough to contribute to or affect the rate of the melting of ice shaped by the device 10.

With sufficient mass of heat-conducting material, such as aluminum, in the upper and lower parts 12, 14, the device 10 will effectively transform a raw chunk of ice 24 into a selected shape form, such as a sphere, with the mold parts 12, 14 starting at ordinary room temperature. If the device 10 is used repetitively without the mass having sufficient time to reabsorb heat energy from the surrounding environment, one or both of the parts 12, 14 can be quickly and sufficiently re-energized by submersion in warm water or simply holding it under a flow of tap water for a few moments.

Figure 3:
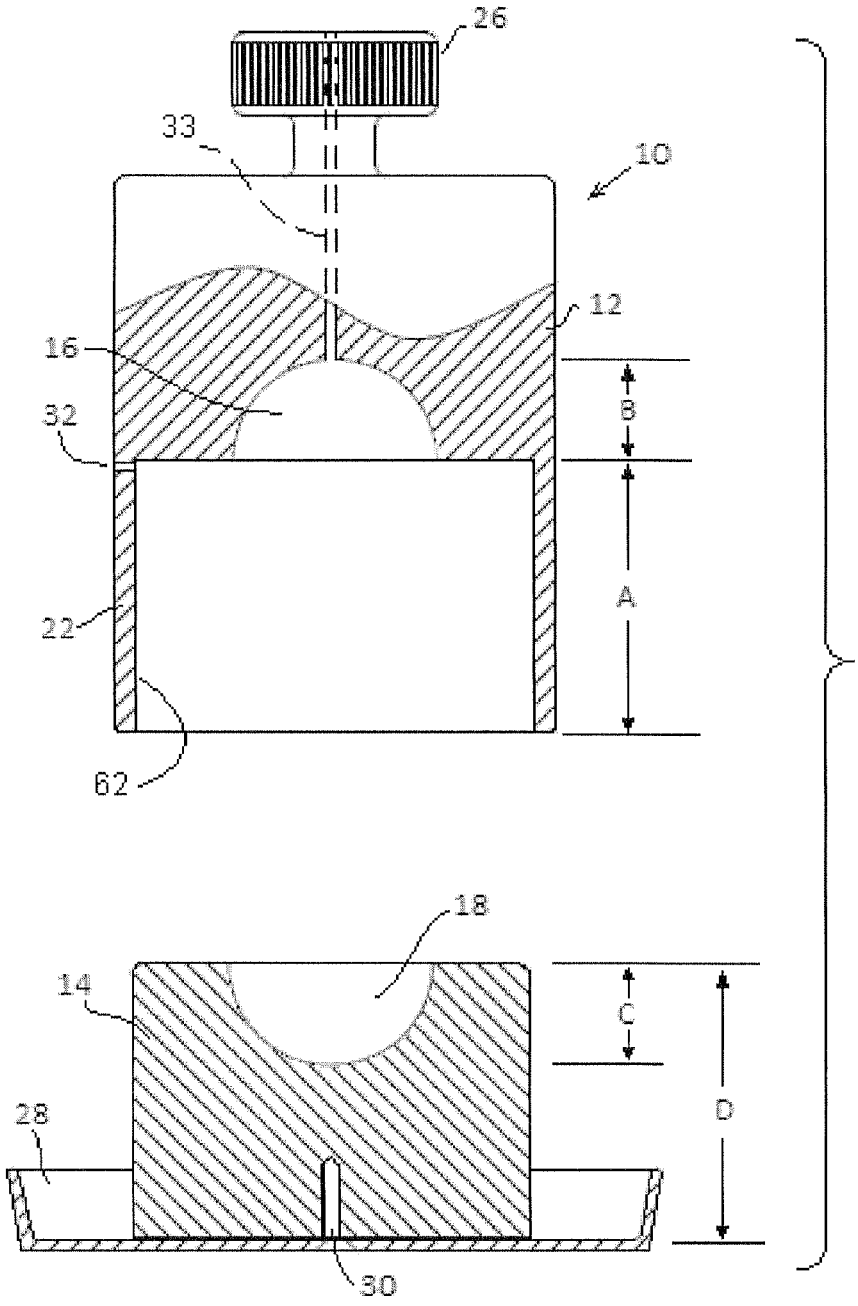
FIG. 3 is a partially cut-away side plan view of the device shown in an open position.
Figure 4:
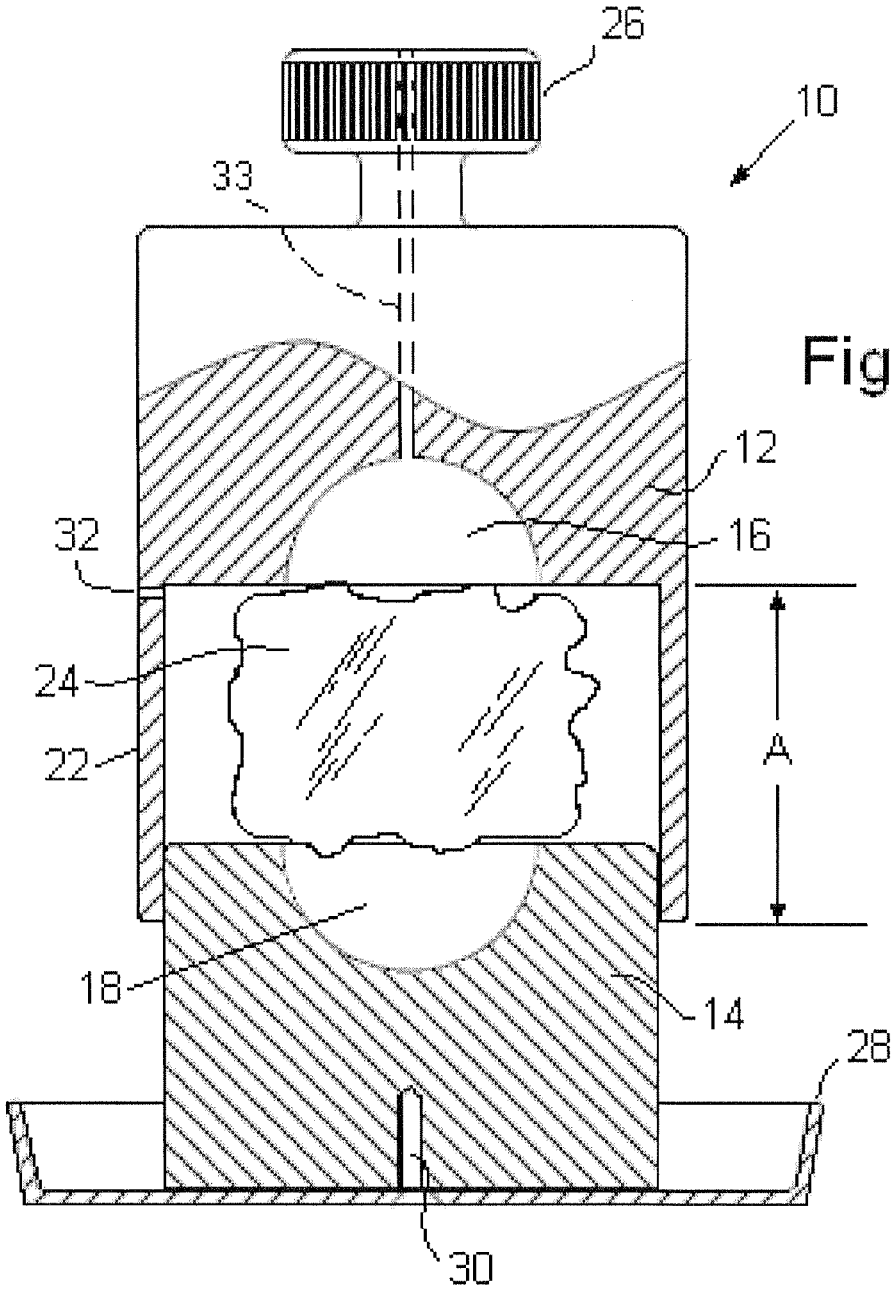
FIG. 4 is a partially cut-away side plan view of the device shown with a chunk of ice in place and ready for shaping.

The device 10 is used by lifting the upper part 12 away from the lower part 14, as shown in FIG. 3. A handle 26 integrally formed with or attached to the top or side of the upper part 12 may be used, if desired. A chunk of ice 24 or a collection of ice chips is placed between the upper and lower parts 12, 14, as shown in FIG. 4. Preferably, the ice chunk 24 is at least as wide as the mold cavity 20 and is at least as tall as the combined heights B, C, of the upper and lower portions 16, 18 of the mold cavity 20. The combined heights B and C are designated as E in FIG. 1.

Figure 8:
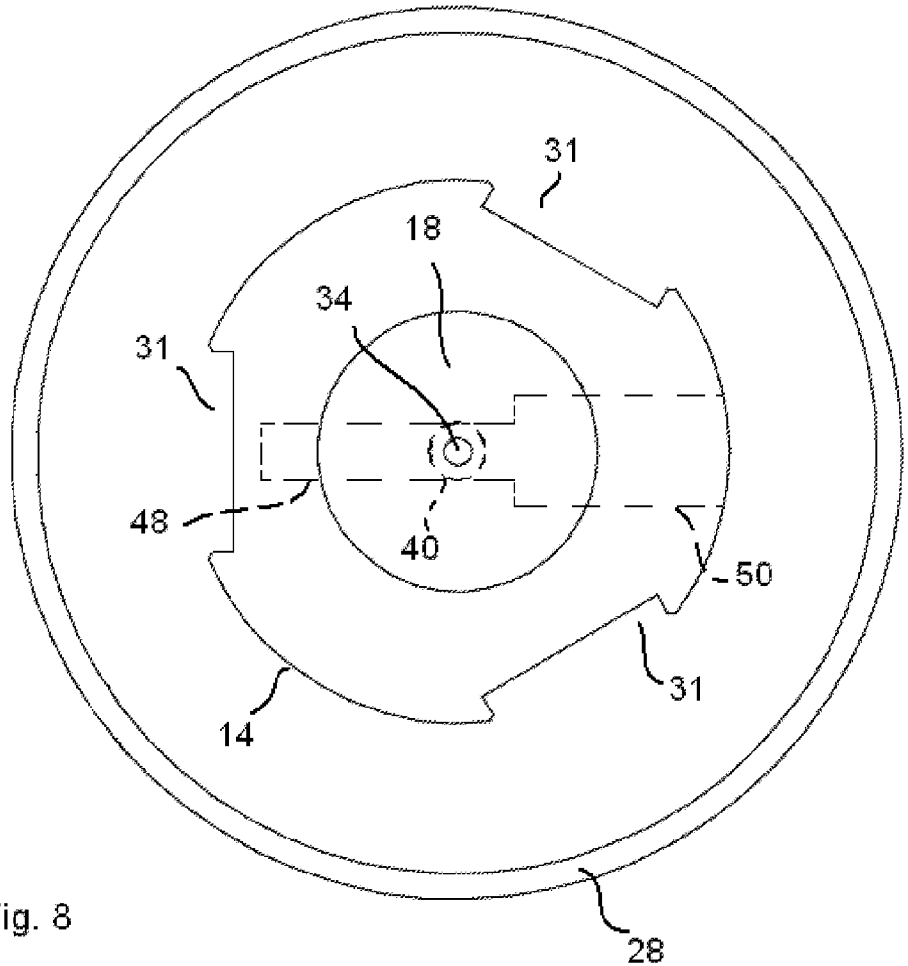
FIG. 8 is a top plan view of the base portion of another alternate embodiment of the device.

Beginning at the position illustrated in FIG. 4, the combined effects of pressure, due to gravity, and rapid heat transfer will cause portions of the ice chunk 24 in direct contact with the upper and lower parts 12, 14 to rapidly melt away, leaving in its place a shaped piece of ice conforming to the mold cavity 20. Melted ice, now water, simply flows away. For the sake of convenience, a catch pan 28 can be placed under the device 10. Alternatively, the catch pan 28 may be incorporated into or attached to the lower part 14, such as by one or more threaded fasteners 30. The catch pan 28 should be sized to hold the typical volume of water produced by an ice chunk 24 to be used with the particular device 10. If desired, flow channels (such as is shown at 31 in FIG. 8) can be provided on or in the mold parts 12, 14 or extended housing 22 to allow water to flow away more quickly. To facilitate removal of the upper part 12 after the ice chunk 24 has been transformed into its desired shape, a vent hole 32 may be formed in the extended housing 22 in order to break any vacuum that may form between the upper and lower parts 12, 14. For the same reason and/or in order to channel water produced by the melting ice and otherwise trapped in the upper or lower portions 16, 18 of the mold cavity, a vent channel 33 may be formed from the mold cavity 20 to the exterior.

As described above and illustrated herein, the present invention operates smoothly and easily without the need for guide rods or guide holes, as are found in prior art devices.

Figure 5:
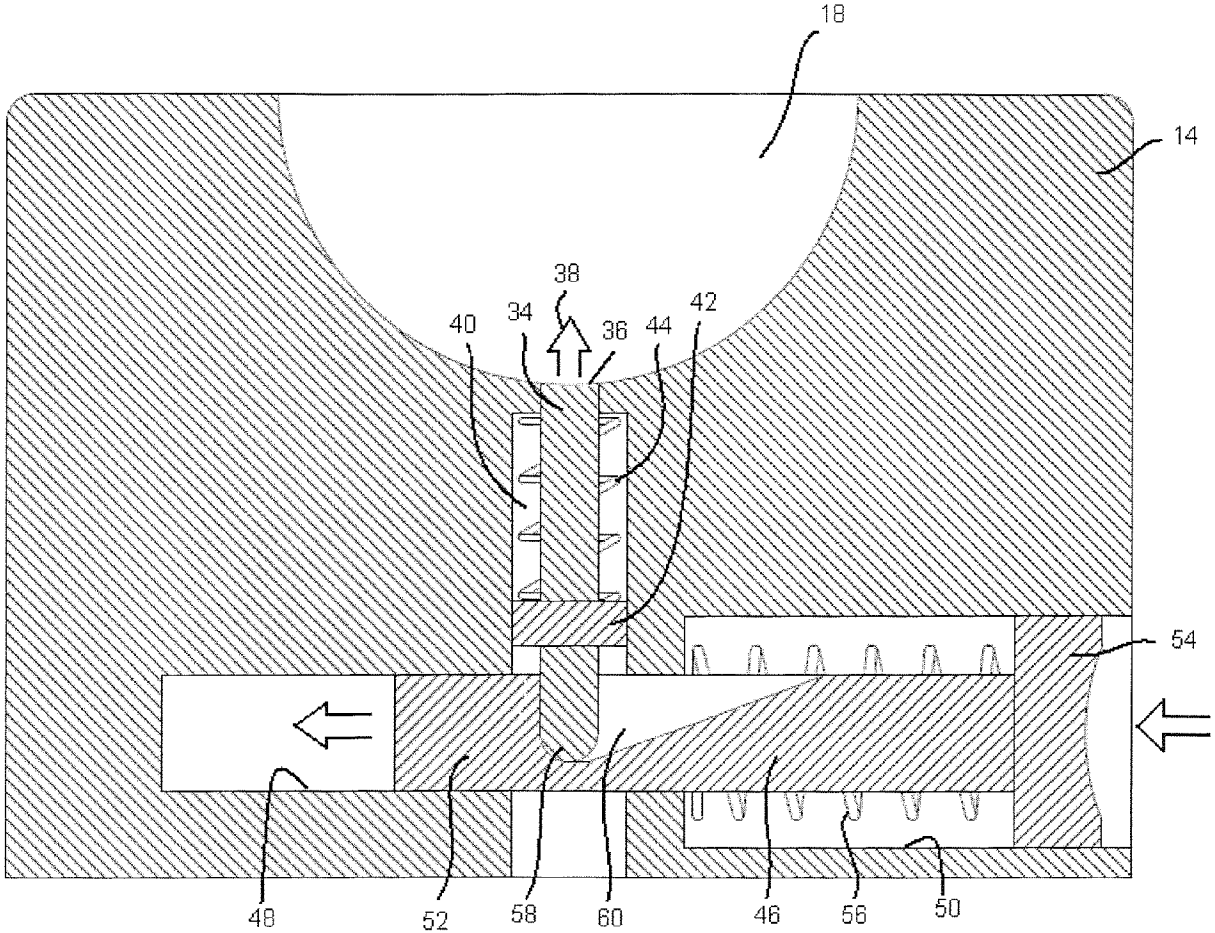
FIG. 5 is a cross-sectional view of the base portion of an alternate embodiment of the device, which includes a mechanism for lifting a shaped ice piece out of the mold.

Referring now to FIG. 5, the device 10 may also include a means to facilitate removal of a transformed ice piece in the upper (not shown) or lower part 14, particularly when the molded shape is one that is difficult to grip with access to only one half, such as a sphere. A lift member 34, which may have a face surface 36 conforming to the shape of the mold cavity 18, will dislodge the molded ice piece when lifted as shown at 38.

As illustrated in FIG. 5, the lift member 34 may be positioned, for example, in a recess 40, guided by a collar 42 and biased toward a "normal" position by a spring 44. The lift member 34 may be operated by transverse movement of an actuation plunger 46 positioned to reciprocate within transverse recesses 48, 50 formed in the lower mold part 14. The plunger 46 may include a stem portion 52 and a head 54. A second spring 56 may be used to bias the plunger 46 into a "normal" position. The lift member 34 may include an end portion 58 which acts as a bearing surface in cooperation with a ramped groove 60 formed in the stem 52 of the plunger 46.

Figure 6:
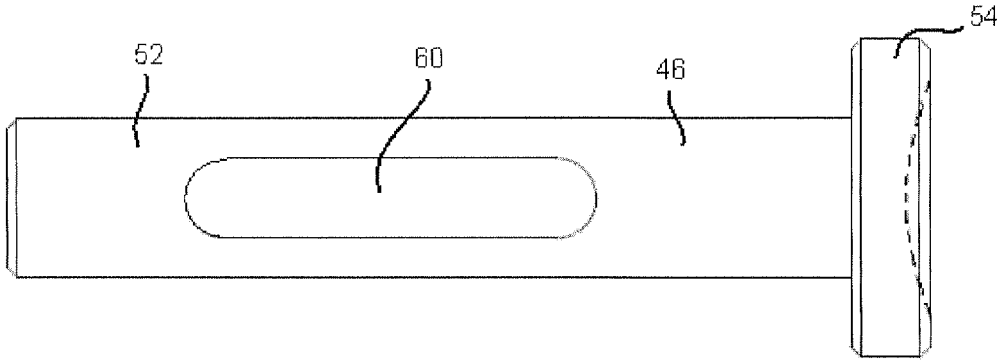
FIG. 6 is a top plan view of a slidable member which is part of the lifting mechanism.
Figure 7:
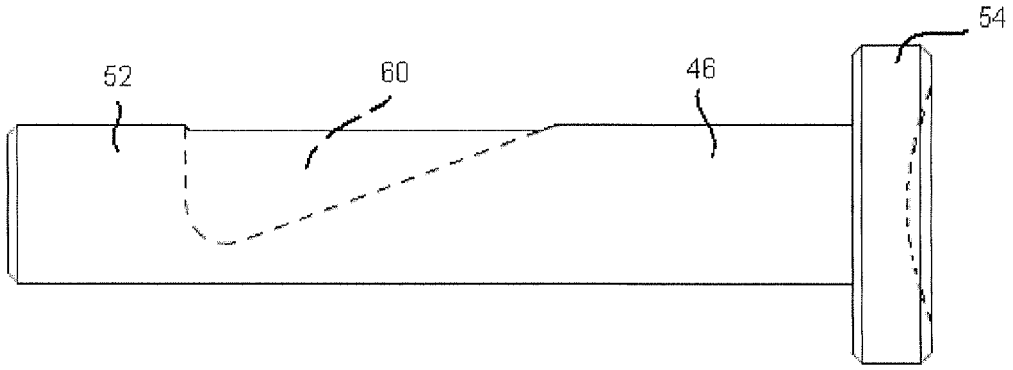
FIG. 7 is a side plan view thereof.

Referring now also to FIGS. 6 and 7, the ramped groove 60 interacts with the end portion 58 of the lift member 34 such that when the plunger 46 is pressed to overcome resistance of the spring 56, the end portion 58 of the lift member 34 glides along the inclined surface of the groove 60 and is raised (arrow 38) against the biasing force of its spring 44 to dislodge a formed ice shape.

Manufacture and assembly of the lifting mechanism is accomplished by simple boring of recesses 40, 48, 50 into the lower part 14 to receive the lift member 34 and plunger 46. The lift member 34 and spring 44 are inserted into the first recess 40 guided by the collar 42. The lift member 34 may be held in an extended position as the plunger 46 and its spring 56 are assembled in place. As soon as the ramped groove 60 passes beyond the position of the end portion 58, the lift member is allowed to drop into place and both members 34, 46 are held in place by their own construction. The lift member 34 and plunger 46 need not sealingly fit within the recesses 40, 48, 50 and, thus, may allow water from melting ice that might otherwise be trapped in the lower portion 18 of the mold cavity to escape (in the same manner as provided by vent opening 33).

Figure 9:
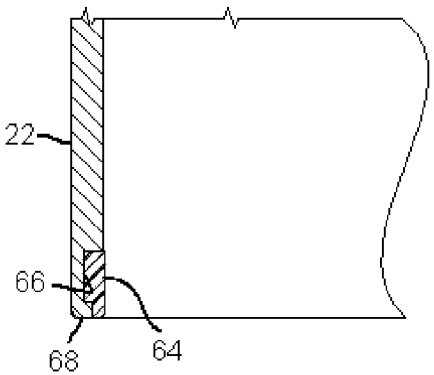
FIG. 9 is a fragmentary sectional view of an edge portion of the upper mold part extension.

If desired, areas of the device 10 that directly contact the ice being shaped for human consumption may be coated with a film of fluoropolymer material such as Endura® 323 or Endura® 300R-V available from Endura Coating LLC of Sterling Heights, Mich. In some embodiments it has been found that a circumferentially continuous extended housing 22 will "ring" when the upper part 12 is lifted off the lower part 14. If this is considered undesirable, the extended housing 22 can be modified in a way that dampens this resonate vibration. According to one example, the inner surface 62 on the extended housing 22 may be coated or a thin adhesive film of vibration dampening material may be applied. One suitable material is 0.005 inch thick adhesive backed polytetrafluoroethylene ("PTFE") film, available as product No. 2208T111 from McMaster-Carr of Chicago, Ill. According to another example, a ring of sound dampening material may be provided in an annular groove formed near the edge of the extended housing 22. For example, as shown in FIG. 9, a ring 64 made of PTFE or similar material could be fitted into an internal groove 66 formed at or near the peripheral edge 68 of the extended housing 22.

Variations of the embodiments of the present invention are not limited to those illustrated and described herein. For example, among many other possible variations, the extended housing 22 could be provided on the lower part 14 of the device and upper part 12 made to fit downwardly into the socket-like space defined by the extended housing 22. The extended housing 22 portion, whether part of the upper 12 or lower 14 part of the device 10, need not be circumferentially and/or axially continuous. Instead, the extended housing can be formed with side openings or as a plurality of legs that fit around the outer perimeter of the opposite mold part 14. Mold cavities 20 for forming multiple ice pieces at the same time could be formed in a single device and could take on a variety of shapes. For the sake of aesthetic appearance, simplicity of construction, and ease of operation, the illustrated embodiment is preferred by the inventor, but many variations may be made without departing from the spirit and scope of the invention. Thus, the scope of my patent protection is to be defined by the following claim or claims, according to accepted doctrines of claim interpretation, including the doctrine of equivalents.

What I claim is:

1. An ice shaping device, comprising:

upper and lower mold parts, at least one of which includes a mold cavity, configured to accommodate an ice chunk blank having a volume larger than the mold cavity between the mold parts, the upper mold part being configured to move toward the lower mold part by gravity; and the upper and lower mold parts being formed of a material capable of rapidly conducting heat and together having a mass such that, starting at room temperature, the mold parts possess sufficient transferable heat to melt away portions of the ice chunk blank in contact with the upper and lower mold parts, the upper mold part having sufficient mass to apply a significant amount of pressure, under the force of gravity, to portions of the ice chunk blank in contact with the mold parts;

wherein a first one of the upper and lower mold parts has a substantially round predetermined exterior periphery larger than that of the ice chunk blank and the other of the mold parts has a circumferentially continuous extension with a length at least equal to a depth dimension of the mold cavity configured to substantially surround and slidably receive the external periphery of the first mold part as the upper mold part moves toward the lower mold part, the upper mold part being configured to move toward the lower mold part substantially solely by the force of gravity as portions of the ice chunk blank in contact with the mold parts melt away until a remaining portion of the ice chunk blank is shaped in conformity with the cavity, wherein the upper mold part is freely axially rotatable relative to the lower mold part as it moves toward the lower mold part while shaping the ice, and wherein at least one of the mold parts includes a channel to allow water melted from the ice chunk blank to flow away from portions of the mold parts in contact with the ice chunk blank.

2. The ice shaping device of claim 1, wherein both mold parts include a cavity, each cavity configured to align when the mold parts are moved together.

3. The ice shaping device of claim 1, wherein the mold parts are formed of an aluminum alloy.

4. The ice shaping device of claim 1, wherein at least one of the mold parts includes a channel to allow the cavity to be vented to break any vacuum formed as the mold parts are separated after forming an ice shape.

5. The ice shaping device of claim 1, further comprising a displaceable lift member to displace a shaped ice piece from the cavity.

6. The ice shaping device of claim 1, further comprising vibration dampening material on the extension.

7. The ice shaping device of claim 1, further comprising a polymer coating on surfaces of the upper and lower mold parts that contact the ice.

* * * * *